US011041690B1

(12) United States Patent
Wei

(10) Patent No.: US 11,041,690 B1
(45) Date of Patent: Jun. 22, 2021

(54) TOY GUN CAPABLE OF PIERCING TWO AIR BOTTLES

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 16/847,039

(22) Filed: Apr. 13, 2020

(51) Int. Cl.
*F41B 11/62* (2013.01)
*F41B 11/73* (2013.01)

(52) U.S. Cl.
CPC ..... *F41B 11/62* (2013.01); *F41B 11/73* (2013.01)

(58) Field of Classification Search
CPC ..... F41B 11/00; F41B 11/60; F41B 11/62; F41B 11/73
USPC ..... 124/56, 71, 73, 74
See application file for complete search history.

(56) References Cited

U.S. PATENT DOCUMENTS 3,067,730 A * 12/1962 Merz ..... F41B 11/62 124/51.1
3,127,885 A * 4/1964 Kline ..... F41B 11/62 124/74
3,830,214 A * 8/1974 Curtis ..... F41B 11/62 124/57
4,116,193 A * 9/1978 Chiba ..... F41B 11/50 124/51.1
5,015,211 A * 5/1991 Reveen ..... A63H 37/00 124/74
5,054,464 A * 10/1991 Young ..... F41B 11/55 124/72
2006/0254570 A1* 11/2006 Dillon, Jr. ..... F41B 11/62 124/69
2013/0192577 A1* 8/2013 Maeda ..... F41B 11/723 124/74
2014/0290637 A1* 10/2014 Maeda ..... F41A 17/38 124/74
2015/0226517 A1* 8/2015 Tseng ..... F41B 11/62 124/56
2016/0040965 A1* 2/2016 Chang ..... F41B 11/62 42/1.08
2018/0188000 A1* 7/2018 Yu ..... F41B 11/62

* cited by examiner

*Primary Examiner* — Bret Hayes
(74) *Attorney, Agent, or Firm* — Chun-Ming Shih; HDLS IPR Services

(57) ABSTRACT

A toy gun capable of piercing two air bottles. The toy gun comprises a gun body, a first piercing member, a screw base, and a moveable rod assembly. The gun body has an air cylinder receiving two air bottles. A connecting tube and a screwed tube are at both ends of the air cylinder. The first piercing member is in the connecting tube. The screw base is screwed to a screwed tube and has a throughhole. The moveable rod assembly has a push rod moveable to penetrate through the throughhole and a return spring flexibly held between the screw base and the push rod having a second piercing member. When pressed, the push rod drives the second piercing member to pierce one of two air bottles and then moves the other towards the first piercing member to be pierced.

5 Claims, 4 Drawing Sheets

TOY GUN CAPABLE OF PIERCING TWO AIR BOTTLES

BACKGROUND OF THE INVENTION

Field of the Invention

The present invention relates to a toy gun structure and in particular to a toy gun capable of piercing two air bottles.

Description of Prior Art

The current toy gun which uses an air bottle as a power source to shoot bullets utilizes the air cylinder which is installed in the gun body to receive the air steel bottle. One end of the air cylinder is provided with a thimble corresponding to the bottle mouth of the air steel bottle; the other end of the air cylinder is screwed to the screw base pressing against the air steel bottle. The screw base can be rotated to push and position the air steel bottle in the gun body. Meanwhile, the bottle mouth of the air steel bottle is pierced by the thimble to release the compressed air in the air steel bottle to provide the power to shoot bullets.

However, the above-mentioned air steel bottle pushed by rotating the screw base to pierce the bottle mouth suffers the following disadvantages. The screw base needs rotating more turns to push the air steel bottle into the air cylinder, which is time- and labor-consuming for the user and actually requires improvement, especially in a survival game in which every second counts.

In view of this, the inventor pays special attention to research with the application of related theory and tries to improve and overcome the above disadvantages regarding the prior art, which becomes the improvement target of the inventor.

SUMMARY OF THE INVENTION

The present invention provides a toy gun capable of piercing two air bottles. The toy gun uses the push rod that can be pressed to drive two air bottles to be individually pierced by the first piercing member and the second piercing member, which further have the effect of quickly piercing two air bottles.

In an embodiment, the present invention provides a toy gun capable of piercing two air bottles installed therein. The toy gun comprises a gun body, a first piercing member, a screw base, and a moveable rod assembly. The gun body has an air cylinder. One end of the air cylinder is provided with a connecting tube; the other end of the air cylinder is provided with a screwed tube. The two air bottles are arranged bottom to bottom and received in the air cylinder. The first piercing member is disposed in the connecting tube. The screw base has an end screwed to the screwed tube and the other end with a bottom end. The screw base is provided with a throughhole penetrating through the bottom end and communicating with the interior of the air cylinder. The moveable rod assembly has a push rod that can move to penetrate through the throughhole and to protrude from the bottom end and a return spring flexibly held between the screw base and the push rod. The second piercing member is disposed at an end of the push rod away from the bottom end. When the push rod is pressed, the push rod can drive the second piercing member to pierce one of the two air bottles and then move the other of the two air bottles towards the first piercing member to be pierced by the first piercing member.

Compared with the prior art which needs more turns for the screw seat to push the air bottle into the air cylinder, the push rod used in the present invention is just pressed to push the air bottle into the air cylinder such that the air bottles are quickly pierced by the first piercing member and by the second piercing member. Therefore, the toy gun of the present invention has the effects of quickly piercing the air bottles and a two-stage piercing of air bottles.

DETAILED DESCRIPTION OF THE INVENTION

Figure 1:
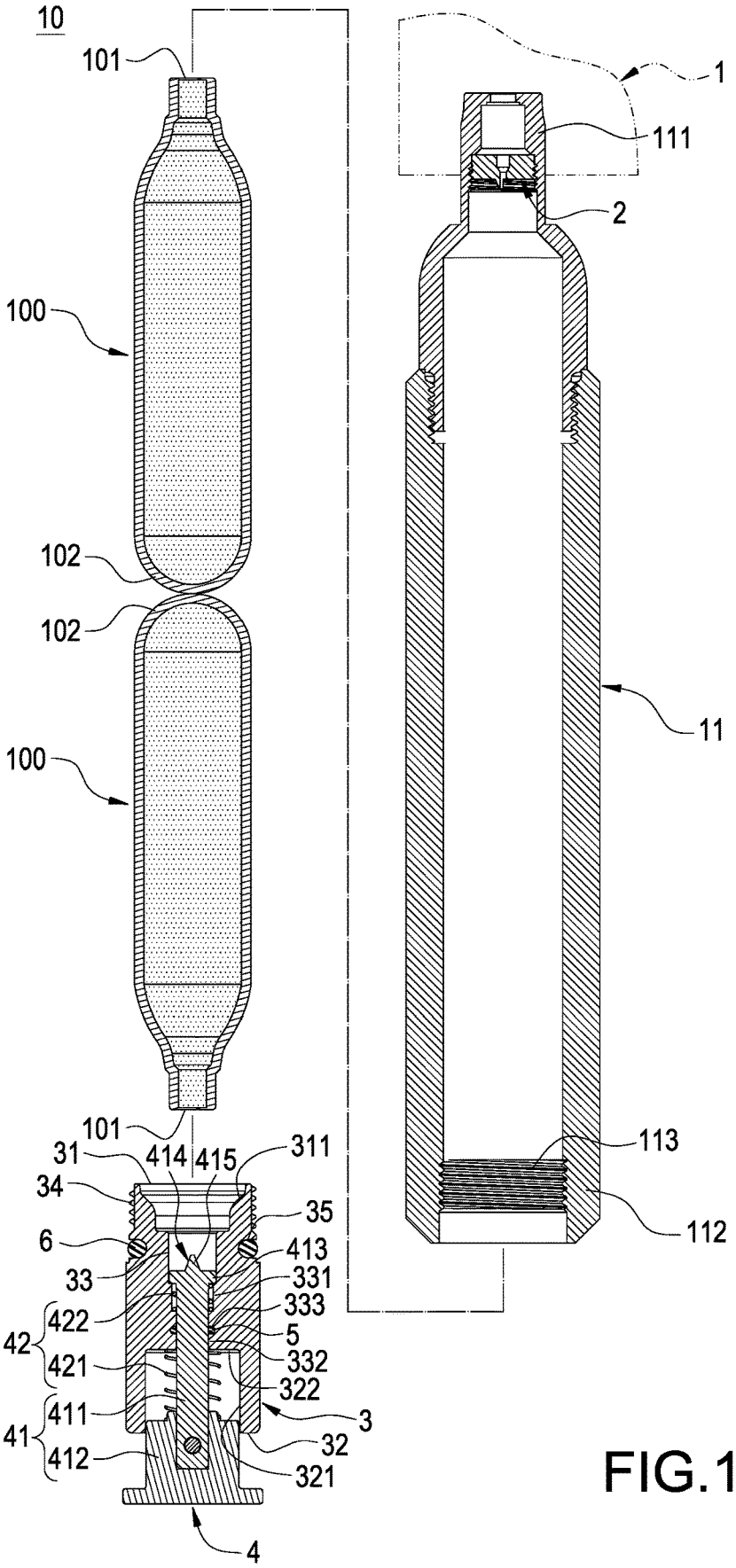
FIG. 1 is a cross-sectional exploded view of the toy gun capable of piercing two air bottles of the present invention.
Figure 2:
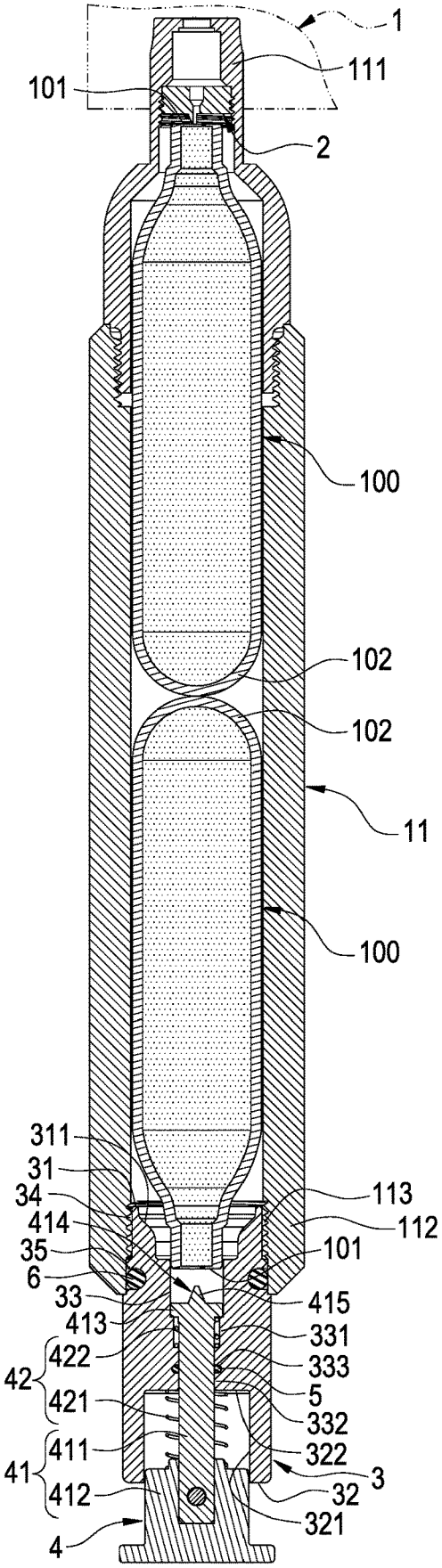
FIG. 2 is a cross-sectional view of the toy gun capable of piercing two air bottles of the present invention.

The detailed description and technical details of the present invention will be explained below with reference to accompanying drawings. However, the accompanying figures are for reference and explanation only, but not to limit the scope of the present invention.

Please refer to FIGS. 1-4. The present invention provides a toy gun capable of piercing two air bottles. The toy gun 10 comprises a gun body 1, a first piercing member 2, a screw base 3, and a moveable rod assembly 4.

The toy gun 10 of the present invention is used to install two air bottles 100. Each air bottle 100 has a bottle mouth 101 at one end thereof and a bottle bottom 102 at the other end thereof. The compressed air generated after the air bottle 100 is pierced is used to provide the actuating power for the toy gun 10.

The gun body 1 has an air cylinder 11. One end of the air cylinder 11 is provided with a connecting tube 111 and the other end of the air cylinder 11 is provided with a screwed tube 112. The connecting tube 111 communicates with the gun barrel (not shown) of the gun body 1 and is used to guide the compressed air generated from the air bottle 100 to flow into the gun barrel to shoot the bullets (not shown). An internal thread 113 is disposed at an inner edge of the screwed tube 112.

In addition, the two air bottles 100 are arranged bottom to bottom and received in the air cylinder 11. The bottle mouth 101 of one of the two air bottles 100 is disposed corresponding to the connecting tube 111; the bottle bottom 102 of the other of the two air bottles 100 is disposed corresponding to the screwed tube 112. The bottle bottoms 102 of the two air bottles 100 press against each other. The first piercing member 2 is disposed in the connecting tube 111.

The screw base 3 has an end with a top end 31 and the other end with a bottom end 32. The screw base 3 is provided with a throughhole 33 penetrating through the bottom end 32 and communicating with the interior of the air cylinder 11.

The detailed description is given below. The outer edge of the screw base 3 is provided with an external thread 34 and a second ring groove 35. The external thread 34 and the internal thread 113 are engaged to each other such that the top end 31 of the screw base 3 is screwed to the screwed tube 112.

Moreover, the bottom end 32 is provided with a recess portion 321 and a bottom surface 322 formed in the recess portion 321; the throughhole 33 is formed through the bottom surface 322. The inner edge of the throughhole 33 extends to form a first projection 331, a second projection 332, and a first ring groove 333 disposed between the first projection 331 and the second projection 332. The top end 31 is provided with a V-shaped recess 311 to fit the shape of the bottle bottom 102 of the air bottle 100, but not limited to this.

The moveable rod assembly 4 has a push rod 41 and a return spring 42. The push rod 41 can move to penetrate through the throughhole 33 and to protrude from the bottom end 32. The return spring 42 is flexibly held between the screw base 3 and the push rod 41. A second piercing member 414 is disposed at an end of the push rod 41 away from the bottom end 32.

Further description is given below. The push rod 41 has a rod body 411 and a press block 412 attached firmly to the rod body 411. The rod body 411 is disposed through the throughhole 33; the press block 412 protrudes from the bottom end 32 and is moveably embedded in the recess portion 321.

In addition, the extruded part 413 extends from an end of the rod body 411 away from the press block 412. The extruded part 413 can be stopped by the first projection 331 to prevent the rod body 411 from separating from the throughhole 33. Also, the second piercing member 414 is a piercing pin 415 protruding from the top of the extruded part 413.

In addition, the return spring 42 has a first spring 421 and a second spring 422. The first spring 421 is clamped between the bottom surface 322 and the press block 412. The press block 412 can be returned to protrude from the top end 32 by the spring return force of the first spring 421 and drives the extruded part 413 to be received in the throughhole 33. The second spring 422 is clamped between the extruded part 413 and the second projection 332.

Further description is given below. Without external force applied, the spring return force of the first spring 421 is larger than that of the second spring 422, which drives the extruded part 413 to be received in the throughhole 33 and the second spring 422 not to return to its original length to be in a compressed state. However, when the press block 412 is pressed to compress the first spring 421 to move the rod body 411 towards the interior of the air cylinder 11, the second spring 422 flexibly returns to a stretched state and drives the extruded part 413 to press against the air bottle 100 and prevent the air bottle 100 from swaying.

When the push rod 41 is pressed by the user, the push rod 41 can move the second piercing member 414 to pierce one of the two air bottles 100 and then move the other of the two air bottles towards the first piercing member 2 to be pierced by the first piercing member 2.

The toy gun 10 of the present invention further comprises a first seal ring 5 that is clamped between the rod body 411 and the screw base 3; the first seal ring 5 is received and embedded in the first ring groove 333. The first seal ring 5 is used to provide an airtight seal between the rod body 411 and the screw base 3.

The toy gun 10 of the present invention further comprises a second seal ring 6 that is clamped between the screwed tube 112 and the screw base 3; the second seal ring 6 is received and embedded in the second ring groove 35. The second seal ring 6 is used to provide an airtight seal between the screwed tube 112 and the screw base 3.

Figure 3:
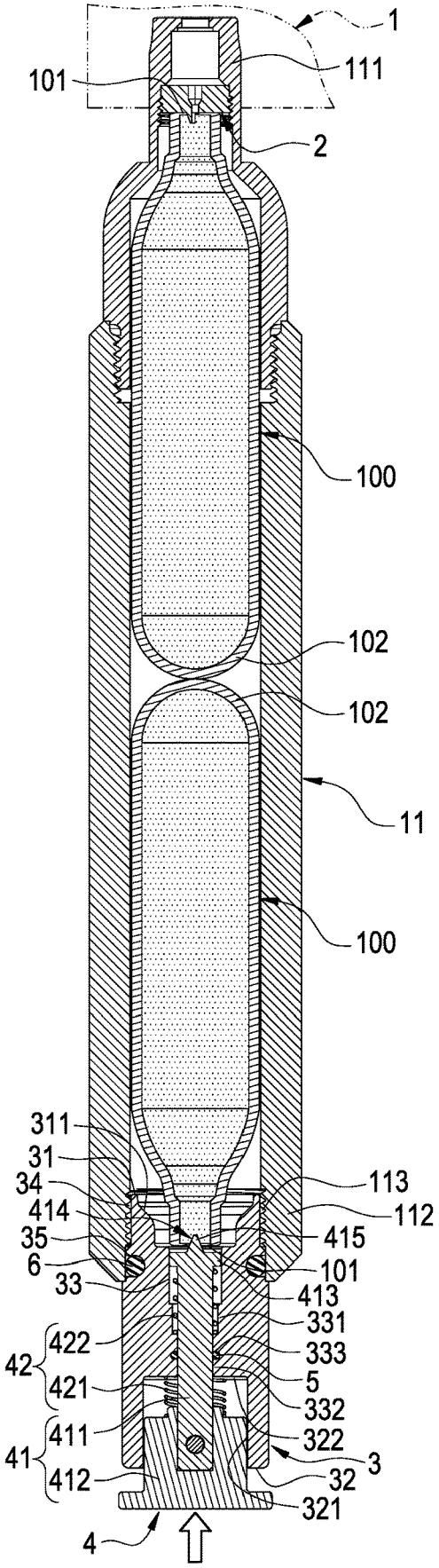
FIG. 3 is a schematic view of the toy gun capable of piercing two air bottles of the present invention in an operational state.
Figure 4:
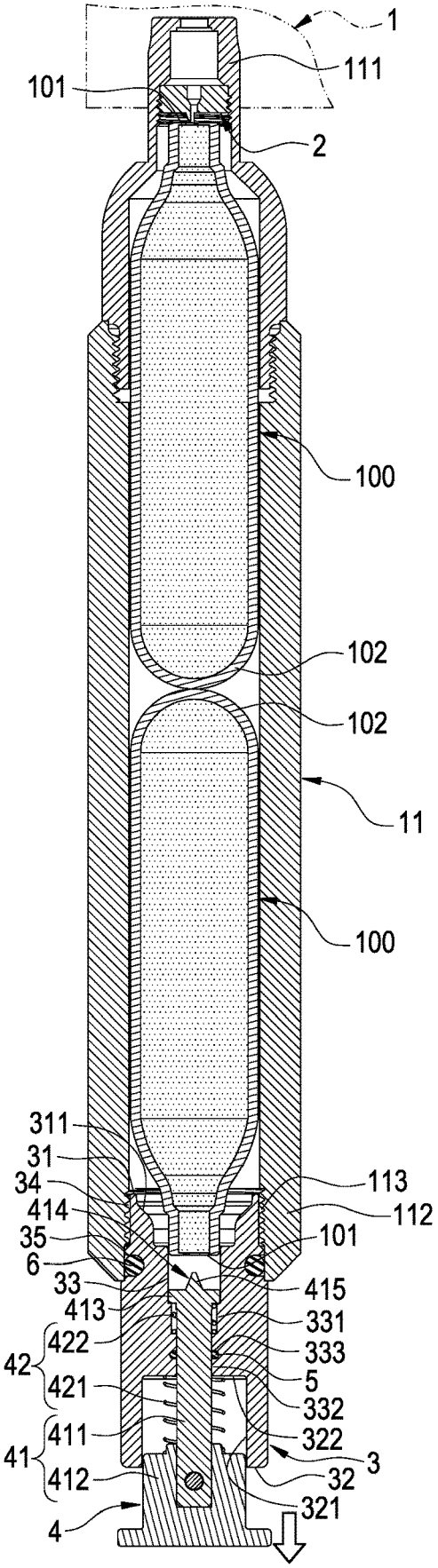
FIG. 4 is a schematic view of the toy gun capable of piercing two air bottles of the present invention in another operational state.

FIGS. 3 and 4 are schematic views of the toy gun 10 of the present invention in operational states. After two air bottles 100 are installed in the air cylinder 11, the user presses the press block 412 to compress the first spring 421 and move the rod body 411 towards the interior of the air cylinder 11. Meanwhile, the extruded part 413 is firstly pressed against the bottle mouth 101 of one of the two air bottles 100 such that the second piercing member 414 pierces the bottle mouth 101 of the air bottle 100. The compressed air generated after the air bottle 100 is pierced flows into the gun barrel through the connecting tube 111 to shoot the bullet.

After that, when the user continues to press the press block 412, the extruded part 413 moves the other air bottle 100 towards the first piercing member 2 until the bottle mouth 101 of the air bottle 100 is pierced by the first piercing member 2, which achieves the effect of piercing the air bottles by a two-stage procedure.

The traditional screw base needs to rotate more turns to move the air bottle into the air cylinder whereas the push rod 41 in the present invention is just pressed and then the air bottle 100 can be pushed into the air cylinder 11 such that the air bottles 100 can be quickly pierced by the first piercing member 2 and by the second piercing member 414. That is, the toy gun 10 has the effects of quickly piercing the air bottles 100 and a two-stage piercing of air bottles.

Furthermore, the spring return force of the first spring 421 can return the extruded part 413 to be received in the throughhole 33 such that the extruded part 413 can remain in the throughhole 33 and cannot touch the air bottle 100 when the push rod 41 is not pressed by the user. Such a design can prevent the air bottle 100 from being carelessly touched to be pierced by the first piercing member 2 or by the second piercing member 414.

In summary, the toy gun capable of piercing two air bottles of the present invention indeed achieves the expected objectives and overcomes the disadvantages of the prior art. Also, the present invention is novel, useful, and non-obvious to be patentable. Please examine the application carefully and grant it as a formal patent for protecting the rights of the inventor.

What is claimed is:

1. A toy gun piercing two air bottles, the two air bottles being installed therein, the toy gun comprising:

a gun body having an air cylinder, wherein one end of the air cylinder is provided with a connecting tube and another end of the air cylinder is provided with a screwed tube, wherein the two air bottles are arranged bottom to bottom and accommodated in the air cylinder;

a first piercing member disposed in the connecting tube;

a screw base having one end screwed to the screwed tube and another end having a bottom end, wherein the screw base is provided with a through hole penetrating through the bottom end and communicating with the air cylinder; and a moveable rod assembly having a push rod moveably penetrating through the through hole and protruding from the bottom end, and a return spring flexibly held between the screw base and the push rod, wherein a second piercing member is disposed at an end of the push rod away from the bottom end, wherein when the push rod is pressed, the push rod drives the second piercing member to pierce one of the two air bottles and then move another one of the two air bottles toward the first piercing member to be pierced by the first piercing member, wherein the bottom end is provided with a recess portion and a bottom surface disposed in the recess portion, wherein the through hole is disposed on the bottom surface, wherein the push rod has a rod body and a press block attached to the rod body, wherein the rod body passes through the through hole, the press block protrudes from the bottom end and is moveably embedded in the recess portion, wherein an extruded part is extended from an end of the rod body away from the press block, a first projection is extended from an inner edge of the through hole to stop the extruded part, wherein the second piercing member is a piercing pin protruding from top of the extruded part, wherein a second projection is extended from the inner edge of the through hole, the return spring has a first spring and a second spring, the first spring is clamped between the bottom surface and the push block, the second spring is clamped between the extruded part and the second projection, the first spring drives the extruded part to be accommodated in the through hole.

2. The toy gun of piercing two air bottles according to claim 1, further comprising a first seal ring that is clamped between the rod body and the screw base, wherein a first ring groove is disposed between the first projection and the second projection at the inner edge of the through hole to receive the first seal ring.

3. The toy gun of piercing two air bottles according to claim 2, further comprising a second seal ring that is clamped between the screwed tube and the screw base, wherein a second ring groove is disposed at an outer edge of the screw base to receive the second seal ring.

4. The toy gun capable of piercing two air bottles according to claim 3, wherein an internal thread is disposed at an inner edge of the screwed tube, wherein an outer edge of the screw base is provided with an external thread engaged with the internal thread.

5. The toy gun of piercing two air bottles according to claim 4, wherein the screwed tube has a top end at which a V-shaped recess is formed.

* * * * *